US008217844B2

(12) United States Patent
Wang et al.

(10) Patent No.: US 8,217,844 B2
(45) Date of Patent: Jul. 10, 2012

(54) ANTENNA FOR RECEIVING ELECTRIC WAVES, A MANUFACTURING METHOD THEREOF, AND AN ELECTRONIC DEVICE WITH THE ANTENNA

(75) Inventors: Chih-Ming Wang, Taipei (TW); Kuan-Hsueh Tseng, Taipei (TW); Chiu-Hui Wu, Taipei (TW); Yuh-Yuh Chiang, Taipei (TW); Shang-Ching Tseng, Taipei (TW)

(73) Assignee: Wistron NeWeb Corp., Hsichih, Taipei (TW)

( * ) Notice: Subject to any disclaimer, the term of this patent is extended or adjusted under 35 U.S.C. 154(b) by 372 days.

(21) Appl. No.: 12/578,264

(22) Filed: Oct. 13, 2009

(65) Prior Publication Data

US 2010/0103056 A1 Apr. 29, 2010

(30) Foreign Application Priority Data

Oct. 28, 2008 (TW) ..... 97141374 A

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS

| | | | | |
|---|---|---|---|---|
| 6,344,825 | B1 * | 2/2002 | Wong | 343/702 |
| 6,809,689 | B1 * | 10/2004 | Chen | 343/700 MS |
| 7,172,304 | B2 | 2/2007 | Rodriguez et al. | |
| 7,206,040 | B2 | 4/2007 | Kano | |
| 2004/0085248 | A1 * | 5/2004 | Onaka et al. | 343/702 |
| 2004/0227672 | A1 * | 11/2004 | Chen et al. | 343/702 |
| 2005/0264447 | A1 * | 12/2005 | Shan | 343/700 MS |

FOREIGN PATENT DOCUMENTS

| | | |
|---|---|---|
| TW | 284224 | 9/2002 |
| TW | 298399 | 10/2002 |

* cited by examiner

*Primary Examiner* — Dieu H Duong
(74) *Attorney, Agent, or Firm* — Muncy, Geissler, Olds & Lowe, PLLC

(57) ABSTRACT

An antenna for receiving electric waves, a manufacturing method thereof, and an electronic device with the antenna are provided. The antenna includes a substrate, a grounding unit, a radiator, a coupling unit, and a signal transmission line. The substrate has a first surface and a second surface which are opposite to each other. The grounding unit is disposed on the first surface of the substrate. The radiator is disposed on the second surface of the substrate and connected to the grounding unit. The coupling unit is disposed on the first surface of the substrate and partially overlaps the projection of the radiator. The signal transmission line includes a signal line and a ground line, the signal line being connected to the coupling unit while the ground line being connected to the grounding unit.

24 Claims, 7 Drawing Sheets

ANTENNA FOR RECEIVING ELECTRIC WAVES, A MANUFACTURING METHOD THEREOF, AND AN ELECTRONIC DEVICE WITH THE ANTENNA

This application claims priority based on a Taiwanese patent application No. 097141374, filed Oct. 28, 2008, the disclosure of which is incorporated herein by reference in its entirety.

BACKGROUND OF THE INVENTION

1. Field of the Invention

The present invention relates to an antenna for receiving electric waves, a manufacturing method thereof, and an electronic device with the antenna. Particularly, the present invention relates to an antenna which applicable to technology domains such as Wireless LAN, an electronic device with the antenna, and a manufacturing method of the antenna.

2. Description of the Related Art

With the increasing demands for wireless communications in recent years, various wireless communication network standards and their related technologies are released to match up the increasingly strict demands for the speed and the quality of wireless communications. Either the Wi-Fi wireless network standard defined by IEEE in IEEE 802.11 or the Worldwide Interoperability for Microwave Access (WiMAX) standard defined in IEEE 802.16 reflects this tendency.

Meanwhile, the design of antennas needs to be enhanced correspondingly, so as to work with new network technologies. FIG. 1 shows a conventional dual-band antenna of U.S. Pat. No. 6,861,986. This dual-band antenna includes a first radiating element 1 and a second radiating element 2 which are both connected to a grounding surface 4. Signals are directly fed through a feed-in point 3 to excite the first radiating element 1 to provide a high frequency band mode which has a center frequency of 5.25 GHz. The direct feed-in signal can also excite the second radiating element 2 to provide a low frequency band mode which has a center frequency of 2.45 GHz. In this conventional dual-band antenna, the length of the second radiating element 2 is about one quarter of its operating frequency.

Consequently, in order to meet the operating frequency in the low frequency band mode, the length of the second radiating element 2 cannot be reduced, and the demands of various small electronic devices cannot be fulfilled.

SUMMARY OF THE INVENTION

It is an objective of the present invention to provide an antenna for receiving electric waves and a manufacturing method thereof, which makes the antenna becoming smaller and having less requirements for space.

It is another objective of the present invention to provide an electronic device, including an antenna which can selectively serve as an engaging unit to ensure the close configuration of the housing of the electronic device.

The antenna of the present invention includes a substrate, a grounding unit, a radiator, a coupling unit, and a signal transmission line. The substrate has a first surface and a second surface which are opposite to each other. The grounding unit is disposed on the first surface of the substrate. The radiator is disposed on the second surface of the substrate and connected to the grounding unit. The coupling unit is disposed on the first surface of the substrate and partially overlaps the projection region of the radiator. The signal transmission line includes a signal line and a ground line. The signal line is connected to the coupling unit, while the ground line is connected to the grounding unit.

The signal transmission line feeds signals through the coupling unit to excite the radiator by coupling effect to generate at least two frequency band modes. In one embodiment, adopting a coaxial cable can serve as the signal transmission line to connect the signal line to the coupling unit and the metallic shield to the grounding unit, and then respectively excites a portion of the radiator or the entire radiator through the coupling unit by coupling effect to generate both the high frequency and the low frequency band modes. Wherein the high frequency band mode can be a 5 GHz ISM band, and the low frequency band mode can be a 2.4 GHz ISM band. The length of the radiator can be shorter than one quarter of the wavelength at the center frequency of the low frequency band mode.

The manufacturing method of the antenna of the present invention includes the following steps: disposing a grounding unit on a first surface of a substrate; disposing a radiator on a second surface of the substrate to be connected to the grounding unit; and disposing a coupling unit on the first surface of the substrate in a manner that the projections of the coupling unit and the second metal arm partially overlap.

DETAILED DESCRIPTION OF THE PREFERRED EMBODIMENT

The present invention provides an antenna for receiving electric waves, an electronic device with the antenna, and a manufacturing method of the antenna. In a preferred embodiment, the antenna of the present invention is applied to various electronic devices for receiving/transmitting wireless signals. Electronic devices preferably include computer motherboards, laptop computers, desktop computers, mobile phones, personal digital assistants, electronic game devices, etc. The possible applications of the wireless signal received/transmitted include wireless local area network (WLAN) and other technologies in need of antennas.

Figure 1:
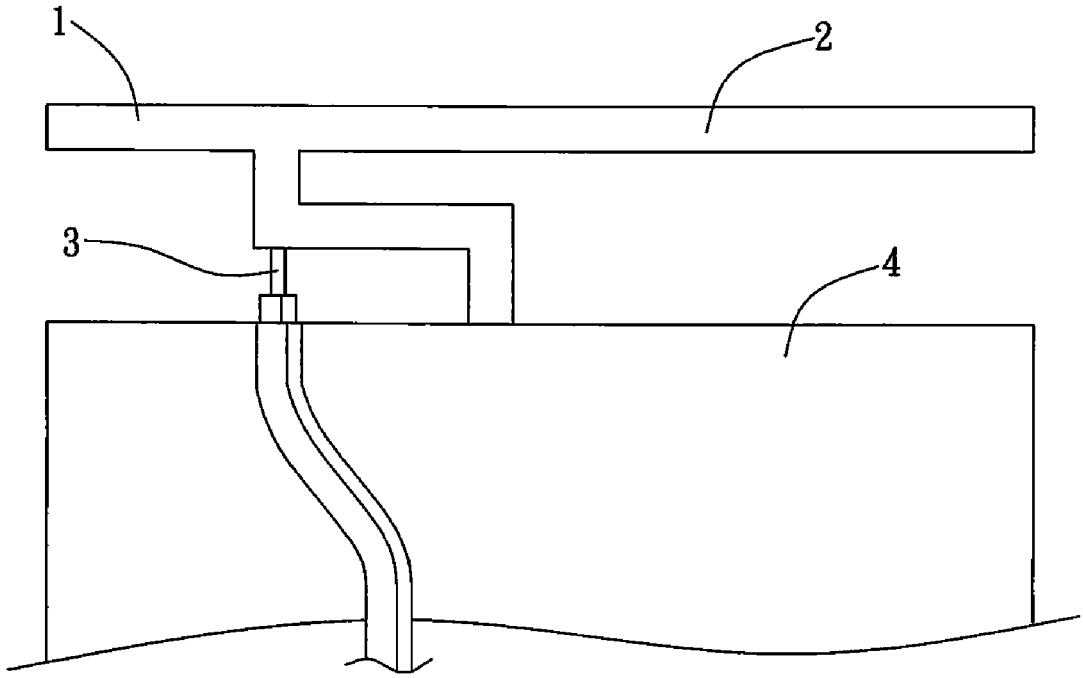
FIG. 1 (PRIOR ART)
FIG. 1 is a schematic view of a conventional dual-band antenna.
Figure 2:
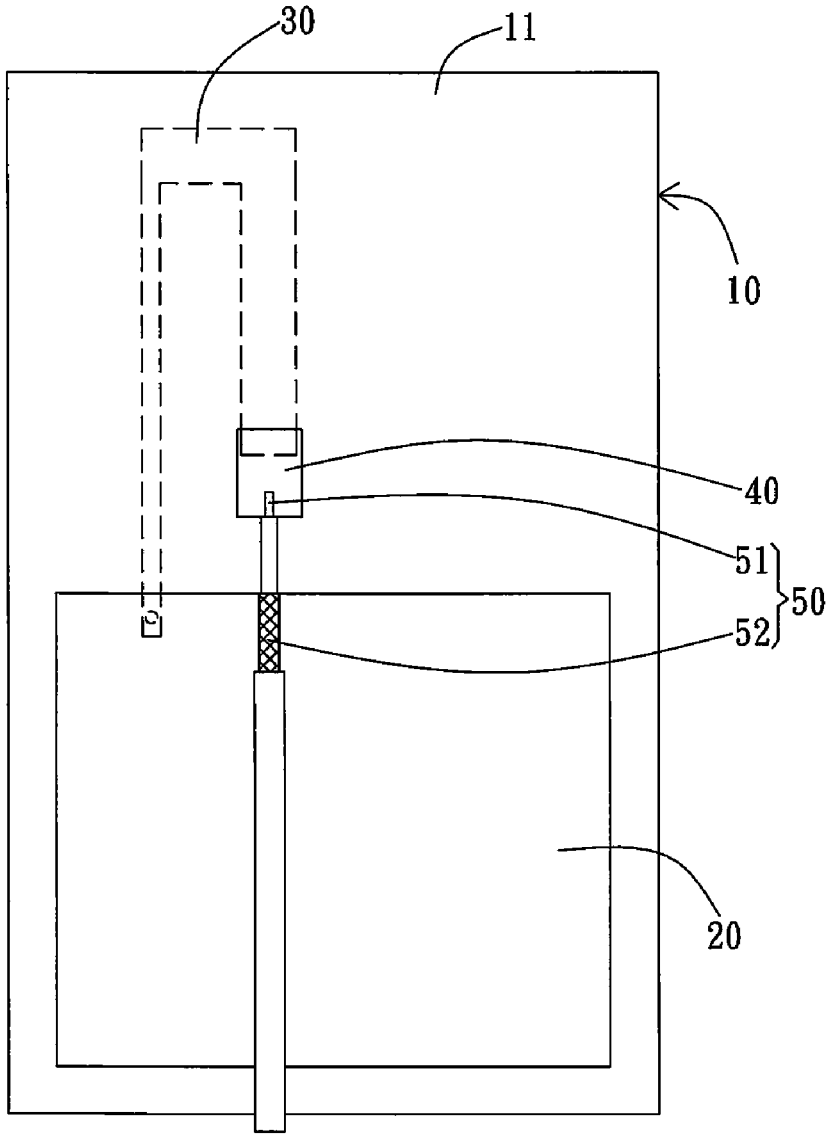
FIG. 2 is a schematic view of an embodiment of a first surface of the antenna of the present invention.
Figure 3:
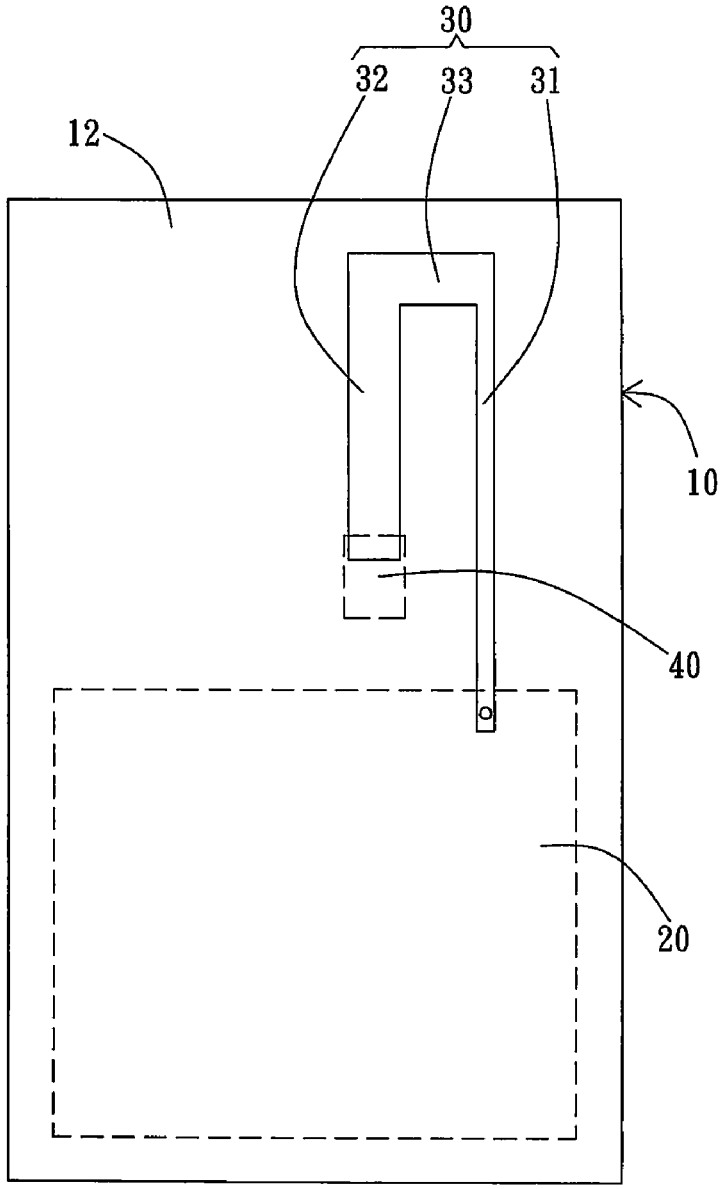
FIG. 3 is a schematic view of an embodiment of a second surface of the antenna of the present invention.

FIG. 2 is a schematic view of an embodiment of a first surface of the antenna of the present invention. As shown in FIG. 2, the antenna includes a substrate 10, a grounding unit 20, a radiator 30, a coupling unit 40, and a signal transmission line 50. The substrate 10 is preferably made of plastics or other dielectric materials, such as printed circuit boards (PCB) or flexible printed circuit (FPC). The substrate 10 is a base material having a thickness and includes two opposite surfaces. FIG. 2 is an arrangement embodiment of a first surface 11 while FIG. 3 is a corresponding arrangement embodiment of a second surface 12. Both surfaces can be used for various components to be mounted thereon.

As shown in FIG. 2, the grounding unit 20 is disposed on the first surface 11 of the substrate 10 and preferably a metal surface formed through printing. The coupling unit 40 is disposed on the first surface 11 of the substrate 10 and preferably a metal surface formed through printing. Furthermore, the shape and the size of the coupling unit 40 can be adjusted in accordance with the impedance matching requirement.

As shown in FIG. 3, the radiator 30 is disposed on the second surface 12 of the substrate 10. In a preferred embodiment, the radiator 30 is a metal strip or a metal microstrip in other geometric shapes which formed on the second surface 12. The radiator 30 is preferably formed on the second surface 12 through printing. However, in other embodiments, other methods can be used to form the radiator 30. The radiator 30 includes a first metal arm 31, a second metal arm 32, and a connecting portion 33. In this embodiment, the projections of the first metal arm 31 and the grounding unit 20 partially overlap. One end of the first metal arm 31 is connected to the grounding unit 20 through a conductive hole, while the other end perpendicularly connects to the connecting portion 33. However, in other embodiments, other methods such as electromagnetic radiation can be adopted to enable the first metal arm 31 and the grounding unit 20 become electrically connected. In this embodiment, the length of the first metal arm 31 is larger than that of the second metal arm 32, and the first metal arm 31 is disposed in the same direction as the second metal arm 32. However, in other embodiments, the length of the first metal arm 31 can be equal to that of the second metal arm 32. "Disposed in the same direction" means the first metal arm 31 and the second metal arm 32 are preferably approximately parallel to each other within a tolerance range. The width of the first metal arm 31 can be adjusted in accordance with the impedance matching requirement. One end of the second metal arm 32 is perpendicularly connected to the connecting portion 33, while the other end is spaced apart from the grounding unit 20 by a distance. The second metal arm 32 has an area larger than that of the coupling unit 40 and the projection of the second metal arm 32 partially overlaps the coupling unit 40. The coupling effect is affected by the overlap area, and accordingly adjusting the size of the area can change the operating frequency of the antenna. In a preferred embodiment, the first metal arm 31 connects to the second metal arm 32 through the connecting portion 33 so that the entire radiator 30 forms a shape similar to the Greek character "I'". The first metal arm 31 and the second metal arm 32 are respectively the longer arm and the shorter arm disposed perpendicularly on two sides, and the connecting portion 33 is a horizontal arm disposed therebetween.

As shown in FIG. 2, the signal transmission line 50 includes a signal line 51 and a ground line 52. The signal line 51 is across the grounding unit 20 and connects to the coupling unit 40. The ground line 52 connects to the grounding unit 20. The combination of the coupling unit 40, the substrate 10, the radiator 30, the grounding unit 20, and the signal transmission line 50 forms a closed loop. The signal transmission line 50 feeds signals through the coupling unit 40 to excite the radiator 30 by coupling effect to generate at least two frequency band modes. In a preferred embodiment, the signal transmission line 50 is a coaxial cable, wherein the center core is connected to the coupling unit 40 while the metallic shield is connected to the grounding unit 20, and then through the coupling unit 40 excites the entire radiator 30 or the second arm 32 of the radiator 30 by coupling effect to generate both the high frequency and the low frequency band modes. The high and low frequency band modes respectively have a center frequency. In a preferred embodiment, the high frequency band mode is the 5 GHz ISM band defined in IEEE 802.11a while the low frequency band mode is the 2.4 GHz ISM band defined in IEEE 802.11b. The lengths of the radiator 30 and the second metal arm 32 are respectively smaller than one quarter of the wavelength at the center frequency of the high frequency band mode and the low frequency band mode, and preferably one sixth to one eighth of the wavelength in the high and low frequency band modes respectively, but not limited to the above-mentioned length.

Figure 4:
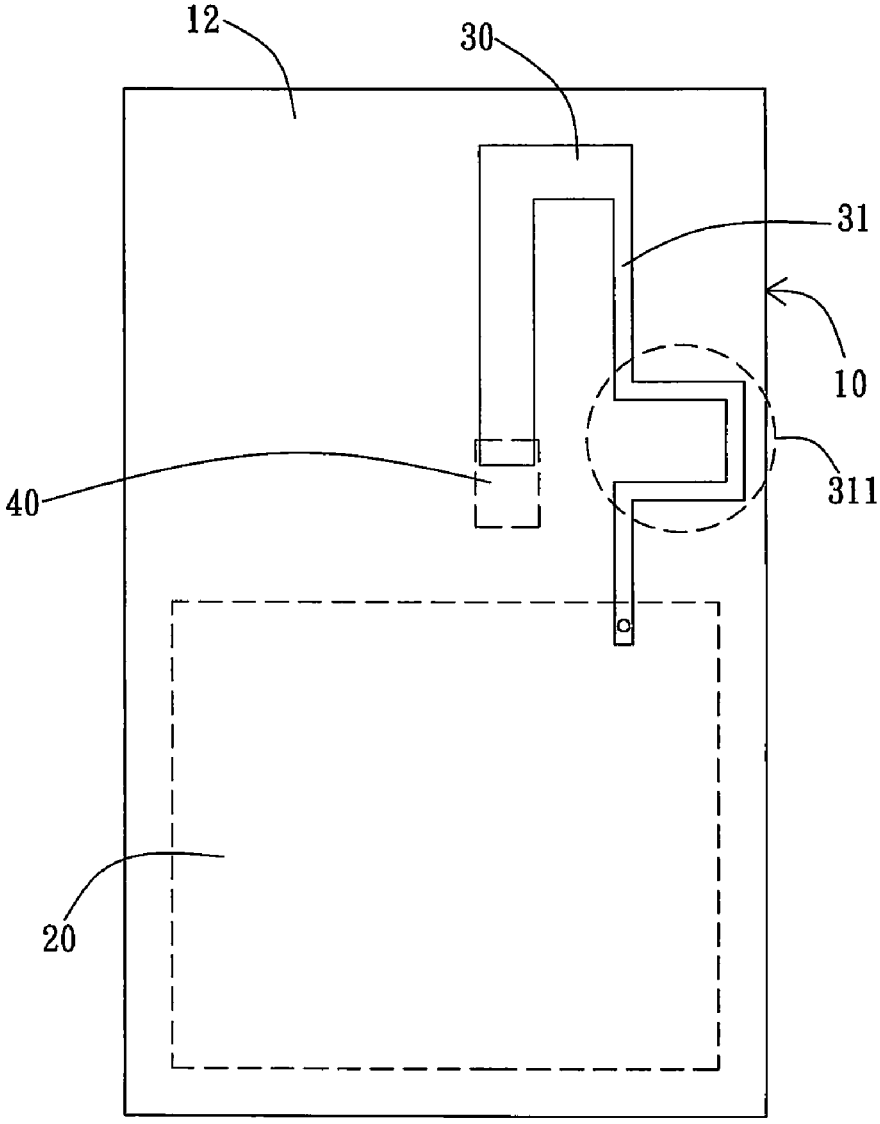
FIG. 4 is a schematic view of another embodiment of the antenna of the present invention.

FIG. 4 is another embodiment of the antenna of the present invention. As shown in FIG. 4, the difference between this embodiment and the embodiment in FIG. 2 is that the first metal arm 31 of the radiator 30 has a bending portion 311 for increasing the length of the first metal arm 31. By increasing the length of the first metal arm 31, the center frequency of the low frequency band mode can become even lower. Besides, to increase the length of the first metal arm 31 by forming more bends in the bending portion 311 according to different design is feasible.

Figure 5:
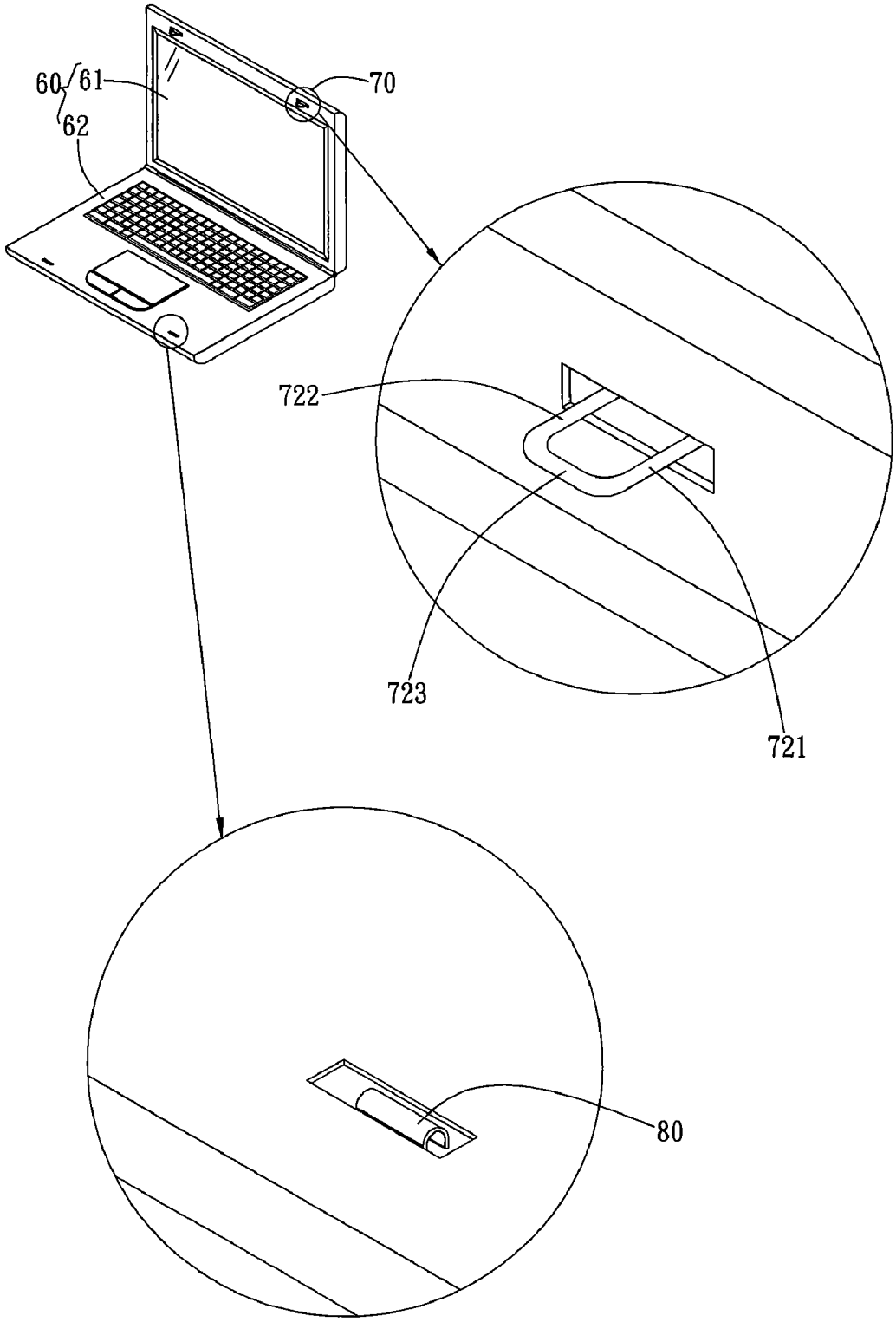
FIG. 5 is a schematic view of an embodiment of the electronic device of the present invention.

FIG. 5 is a schematic view of an embodiment of an electronic device of the present invention. As shown in FIG. 5, the electronic device includes a housing 60, an antenna 70, and a hook 80. The housing 60 includes a first housing 61 and a second housing 62 which are opposite to each other. In a preferred embodiment, the housing 60 is a housing of laptop computers. The first housing 61 is the upper cover, and the second housing 62 is the body. However, in other embodiments, the electronic device can be a cell phone, a personal digital assistant, a portable entertainment device, or other devices in need of wireless communications.

Figure 6:
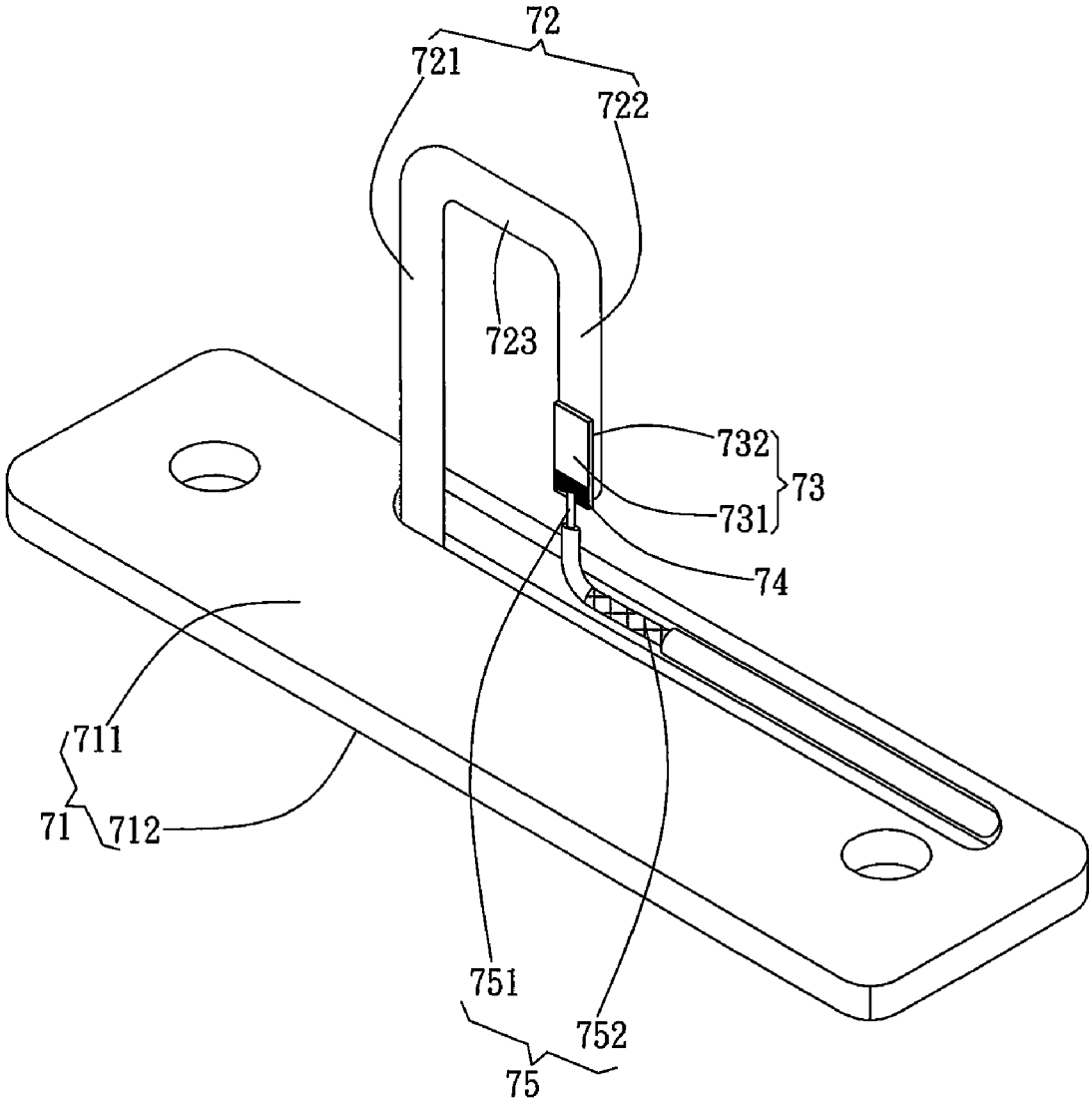
FIG. 6 is a schematic view of yet another embodiment of the antenna of the present invention.

As shown in FIG. 5, the antenna 70 is disposed on an edge of the first housing 61. As shown in FIG. 6, the antenna 70 includes a grounding unit 71, a radiator 72, a substrate 73, a coupling unit 74, and a signal transmission line 75. The grounding unit 71 includes a third surface 711 and a fourth surface 712 which are opposite to each other. The third surface 711 is tightly close to the first housing 61 while the radiator 72 perpendicularly extends out the forth surface 712. The radiator 72 includes a first metal arm 721, a second metal arm 722, and a connecting portion 723. In this embodiment, one end of the first metal arm 721 perpendicularly connects to the grounding unit 71, while the other end perpendicularly connects to the connecting portion 723. The length of the first metal arm 721 is larger than that of the second metal arm 722 and is disposed in the same direction as the second metal arm 722. "Disposed in the same direction" means the first metal arm 31 and the second metal arm 32 are preferably approximately parallel to each other within a tolerance range. One end of the second metal arm 722 is perpendicularly connected to the connection portion 723 while the other end is spaced apart from the grounding unit 71 by a distance. In a preferred embodiment, the first metal arm 721 connects to the second metal arm 722 through the connecting portion 723 in a manner that the entire radiator 72 forms a shape similar to the Greek character "I'".

The substrate 73 is a base material having a thickness, and includes a first surface 731 and a second surface 732 which are opposite to each other. The two surfaces can be utilized for various components to be mounted thereupon. As shown in FIG. 6, the second surface 732 of the substrate 73 connects to the second metal arm 722 of the radiator 72. The substrate 73 is preferably made of polyethylene terephthalate (PET) or other dielectric materials, such as printed circuit boards (PCB) or flexible printed circuit (FPC). The coupling unit 74 is disposed on the first surface 731 of the substrate 73 and preferably a metallic surface formed by printing. Besides, the shape and the size of the coupling unit 74 can be adjusted in accordance with the impedance matching requirement. The second metal arm 722 has an area larger than that of the coupling unit 74 and the projection of the second metal arm 722 partially overlaps the coupling unit 74 with the substrate 73 in between. The coupling effect is affected by the overlap area, and accordingly adjusting the size of the area can change the operating frequency of the antenna.

As shown in FIG. 6, the signal transmission line 75 includes a signal line 751 and a ground line 752. The signal line 751 connects to the coupling unit 74. The ground line 752 connects to the forth surface 712 of the grounding unit 71. The combination of the coupling unit 74, the substrate 73, the radiator 72, the grounding unit 71 and the signal transmission line 75 forms a closed loop. The signal transmission line 75 feeds signals through coupling unit 74 to excite the radiator 72 by coupling effect to generate at least two frequency band modes. In a preferred embodiment, the signal transmission line 75 is a coaxial cable, wherein the center core is connected to the coupling unit 74, and the metallic shield is connected to the grounding unit 71 and then through the coupling unit 74 excites entire radiator 72 or the second metal arm 722 of the radiator 72 by coupling effect to generate both the high frequency and the low frequency band modes. The high and low frequency band modes respectively have a center frequency. In a preferred embodiment, the high frequency band mode is the 5 GHz ISM band defined in IEEE 802.11a while the low frequency band mode is the 2.4 GHz ISM band defined in IEEE 802.11b. The lengths of the radiator 72 and the second metal arm 722 are respectively smaller than one quarter of the wavelength at the center frequency of the high frequency band mode and the low frequency band mode, and preferably one sixth to one eighth of the wavelength in the high and low frequency band modes respectively, but not limited to the above-mentioned length.

As shown in FIG. 5, the hook 80 is disposed on the edge of the second housing 62 corresponding to the antennas 70 on the first housing 61. When the first housing 61 covers the second housing 62, the hook 80 engages with the radiators 72 on the first housing 61. The hook 80 is preferably engages with the connecting portion 723 of the radiator 72. However, in other embodiments, the hook 80 can engage with the first metal arm 721 or the second metal arm 722 as appropriate. In a preferred embodiment, the radiator 72 can be disposed on the upper cover of laptop computers to serve as a tenon. The hook 80 can be disposed on the computer body to cooperate with the radiator 72 to ensure the close configuration of the upper cover and the computer body. When the housing of laptop computer is in an open configuration, the radiator 72 can operate as an antenna.

Figure 7:
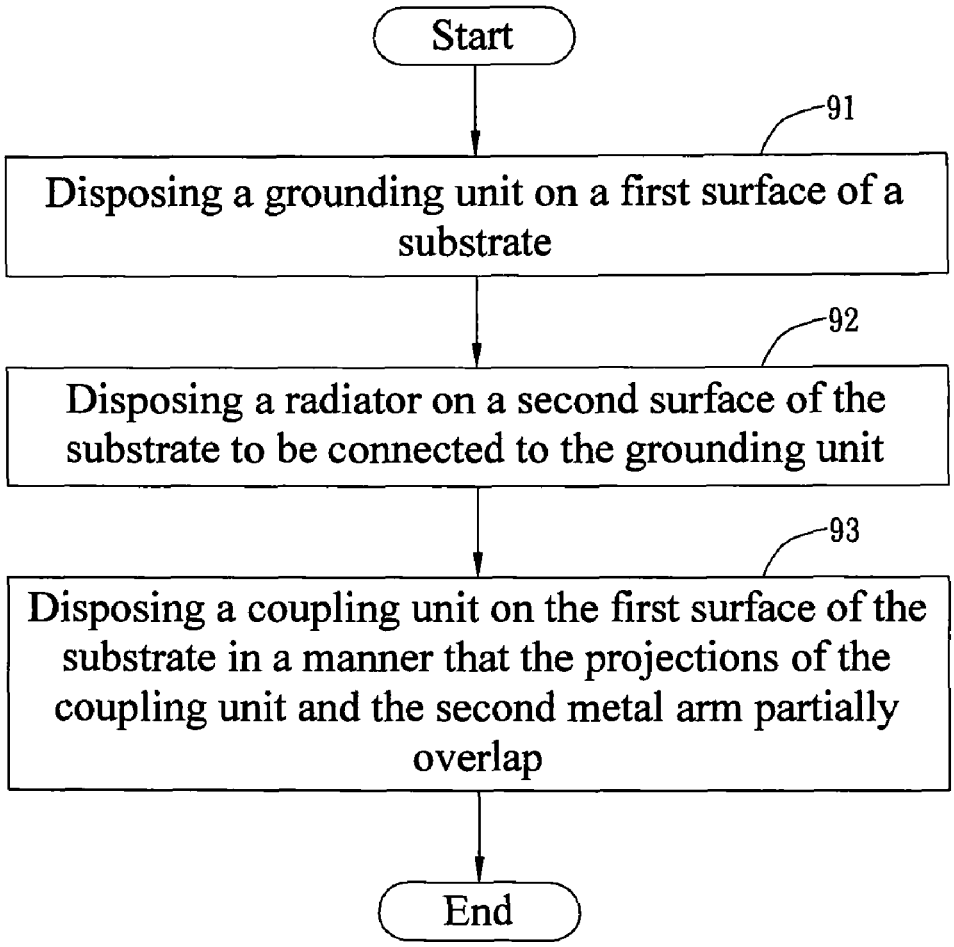
FIG. 7 is a flow chart of an exemplary method of manufacturing the antenna of the present invention.

FIG. 7 is a flow chart of an exemplary method of manufacturing the antenna of the present invention. The method includes Step 91, disposing a grounding unit on a first surface of a substrate. In a preferred embodiment, the grounding unit is a metallic surface formed by printing.

The method further includes Step 92, disposing a radiator on a second surface of the substrate to be connected to the grounding unit. In a preferred embodiment, the radiator is a metal strip or a metal microstrip in other geometric shapes formed on the second surface. The radiator is preferably formed on the second surface through printing. However, in other embodiments, other methods can be used to form the radiator. The radiator includes a first metal arm, a second metal arm, and a connecting portion. In this embodiment, the projections of the first metal arm and the grounding unit partially overlap. One end of the first metal arm is connected to the grounding unit through a conductive hole, while the other end perpendicularly connects to the connecting portion. However, in other embodiments, other methods can be adopted to enable the first metal arm and the grounding unit become electrically connected. The length of the first metal arm is larger than that of the second metal arm, and the first metal arm is disposed in the same direction as the second metal arm. "Disposed in the same direction" means the first metal arm and the second metal arm are preferably approximately parallel to each other within a tolerance range. The width of the first metal arm can be adjusted in accordance with the impedance matching requirement. One end of the second metal arm is perpendicularly connected to the connecting portion, while the other end is spaced apart from the grounding unit by a distance. The second metal arm has an area larger than that of the coupling unit and the projection of the second metal arm partially overlaps the coupling unit. The coupling effect is affected by the overlap area, and accordingly adjusting the size of the area can change the operating frequency of the antenna. In a preferred embodiment, the first metal arm connects to the second metal arm through the connecting portion so that the entire radiator forms a shape similar to the Greek character "I". Besides, in a preferred embodiment, a portion of the first metal arm can be disposed on the first surface of the substrate in a bending manner to increase the length of the first metal arm. By increasing the length of the first metal arm, the center frequency of the low frequency band mode can become even lower. Besides, to increase the length of the first metal arm by forming more bends in the bending portion according to different design is feasible.

The method also includes Step 93, disposing a coupling unit on the first surface of the substrate in a manner that the projections of the coupling unit and the second metal arm partially overlap. In a preferred embodiment, the coupling unit is a metallic surface formed by printing. The shape and the size of the coupling unit can be adjusted in accordance with the impedance matching requirement. Furthermore, step 93 further includes connecting a signal line of a signal transmission line to the coupling unit, and connecting a ground line of the signal transmission line to the grounding unit. The signal transmission line feeds signals through the coupling unit to excite the radiator by coupling effect to generate at least two frequency band modes. In a preferred embodiment, the signal transmission line is a coaxial cable, wherein the center core is connected to the coupling unit, and the metallic shield is connected to the grounding unit and then through the coupling unit excites the entire radiator or the second metal arm of the radiator by coupling effect to generate both the high frequency and the low frequency band modes. The high and low frequency band modes respectively have a center frequency. Wherein the high frequency band mode is the 5 GHz ISM band defined in IEEE 802.11a while the low frequency band mode is the 2.4 GHz ISM band defined in IEEE 802.11b. The lengths of the radiator and the second metal arm are respectively smaller than one quarter of the wavelength at the center frequency of the high frequency band mode and the low frequency band mode, and preferably one sixth to one eighth of the wavelength in the high and low frequency band modes respectively, but not limited to the above-mentioned length.

Although the present invention has been described through the above-mentioned related embodiments, the above-mentioned embodiments are merely the examples for practicing the present invention. What need to be indicated is that the disclosed embodiments are not intended to limit the scope of the present invention. On the contrary, the modifications within the essence and the scope of the claims and their equivalent dispositions are all contained in the scope of the present invention.

What is claimed is:

1. An antenna, comprising:

a substrate including a first surface and a second surface opposite to the first surface;

a grounding unit disposed on the first surface of the substrate;

a radiator disposed on the second surface of the substrate, including a first metal arm, a second metal arm, and a connecting portion, wherein the first metal arm and the second metal arm are at least partially distributed in the same direction, the first metal arm has a length larger than or equal to that of the second metal arm, the first metal arm is connected to the grounding unit, two ends of the connecting portion are connected to the first metal arm and the second metal arm respectively and substantially across a space between the first metal arm and the second metal arm;

a coupling unit disposed on the first surface, wherein the coupling unit and the second metal arm partially overlap without contacting each other, the coupling unit excites the radiator by coupling effect to selectively generate at least one of a first frequency band mode and a second frequency band mode; and a signal transmission line including a signal line and a ground line, wherein the signal line is connected to the coupling unit and the ground line is connected to the ground unit.

2. The antenna of claim 1, wherein the first metal arm has at least one bending portion.

3. The antenna of claim 1, wherein the connecting portion is connected to an end of at least one of the first metal arm and the second metal arm.

4. The antenna of claim 1, wherein the first metal arm and the second metal arm are substantially parallel to each other.

5. The antenna of claim 1, wherein the second metal arm has an area larger than that of the coupling unit.

6. The antenna of claim 1, wherein a distance is provided between the second metal arm and the grounding unit.

7. The antenna of claim 1, wherein the first metal arm and the grounding unit partially overlap without contacting each other, the substrate includes a conductive hole formed between the overlap of the grounding unit and the first metal arm, and the first metal arm and the grounding unit are connected through the conductive hole.

8. The antenna of claim 1, wherein the first frequency band mode has a first center frequency and a first wavelength corresponding to the first center frequency, the length of the second metal arm is substantially equal to a wavelength ranging from one sixth to one eighth of the first wavelength.

9. The antenna of claim 1, wherein the second frequency band mode has a second center frequency and a second wavelength corresponding to the second center frequency, the total length of the radiator is substantially equal to a wavelength ranging from one sixth to one eighth of the second wavelength.

10. An electronic device including an antenna, the antenna comprising:

a substrate including a first surface and a second surface opposite to the first surface;

a grounding unit disposed on the first surface of the substrate;

a radiator disposed on the second surface of the substrate, including a first metal arm, a second metal arm, and a connecting portion, wherein the first metal arm and the second metal arm are at least partially distributed in the same direction, the first metal arm has a length larger than or equal to that of the second metal arm, the first metal arm is connected to the grounding unit, two ends of the connecting portion are connected to the first metal arm and the second metal arm respectively and substantially across a space between the first metal arm and the second metal arm;

a coupling unit disposed on the first surface, wherein the coupling unit and the second metal arm partially overlap without contacting each other, the coupling unit excites the radiator by coupling effect to selectively generate at least one of a first frequency band mode and a second frequency band mode; and a signal transmission line including a signal line and a ground line, wherein the signal line is connected to the coupling unit and the ground line is connected to the grounding unit.

11. The electronic device of claim 10, further comprising:

a housing including a first housing and a second housing, wherein the antenna is disposed on an edge of the first housing; and a hook disposed on an edge of the antenna for selectively engaging with the radiator.

12. The electronic device of claim 10, wherein the first metal arm includes at least a bending portion.

13. The electronic device of claim 10, wherein the connecting portion is connected to an end of at least one of the first metal arm and the second metal arm.

14. The electronic device of claim 10, wherein the first metal arm and the second metal arm are substantially parallel to each other.

15. The electronic device of claim 10, wherein the area of the second metal arm is larger than that of the coupling unit.

16. The electronic device of claim 10, wherein a distance is provided between the second metal arm and the grounding unit.

17. The electronic device of claim 10, wherein the first metal arm and the grounding unit partially overlap without contacting each other, the substrate includes a conductive hole formed between the overlap of the the grounding unit and the first metal arm, the first metal arm and the grounding unit are connected through the conductive hole.

18. The antenna of claim 10, wherein the first frequency band mode has a first center frequency and a first wavelength corresponding to the first center frequency, the length of the second metal arm is substantially equal to a wavelength ranging from one sixth to one eighth of the first wavelength.

19. The antenna of claim 10, wherein the second frequency band mode has a second center frequency and a second wavelength corresponding to the second center frequency, the total length of the radiator is substantially equal to a wavelength ranging from one sixth to one eighth of the second wavelength.

20. A method for manufacturing an antenna, comprising:

disposing a grounding unit on a first surface of a substrate;

disposing a radiator on a second surface of the substrate to be connected to the grounding unit, wherein the second surface is opposite to the first surface, the radiator includes a first metal arm, a second metal arm, and a connecting portion, the first metal arm and the second metal arm are at least partially parallel to each other, the first metal arm has a length larger than or equal to that of the second metal arm, two ends of the connecting portion are respectively connected to the first metal arm and the second metal arm, and substantially across a space between the first metal arm and the second metal arm;

disposing a coupling unit on the first surface in a manner that the coupling unit and the second metal arm partially overlap without contacting each other; and exciting the radiator to selectively generate at least one of a first frequency band mode and a second frequency band mode by coupling effect.

21. The method of claim 20, wherein the step of disposing the radiator comprises:

distributing the first metal arm and the second metal arm in a same direction;

connecting the connecting portion to an end of at least one of the first metal arm and the second metal arm.

22. The method of claim 20, wherein the step of disposing the radiator further comprises:

forming at least a conductive hole on the substrate, so that the first metal arm and the grounding unit partially overlap without contacting each other in a region near the conductive hole; and connecting the first metal arm to the grounding unit through the conductive hole.

23. The method of claim 20, wherein the step of disposing the radiator comprises disposing a portion of the first metal arm on the first surface of the substrate in a bending manner.

24. The method of claim 20, wherein the step of exciting the radiator comprises:

connecting a signal line of a signal transmission line to the coupling unit; and connecting a ground line of the signal transmission line to the grounding unit.

* * * * *